US005161618A

United States Patent [19]

Jones et al.

[11] Patent Number: 5,161,618

[45] Date of Patent: Nov. 10, 1992

[54] MULTIPLE FRACTURES FROM A SINGLE WORKSTRING

[75] Inventors: Lloyd G. Jones, Dallas; Malcolm K. Strubhar, Irving; William P. Donlon, Dallas, all of Tex.

[73] Assignee: Mobil Oil Corporation, Fairfax, Va.

[21] Appl. No.: 745,657

[22] Filed: Aug. 16, 1991

[51] Int. Cl.[5] ..... E21B 43/26

[52] U.S. Cl. ..... 166/308; 166/280; 166/242

[58] Field of Search ..... 166/308, 280, 281, 282, 166/283, 242

[56] References Cited

U.S. PATENT DOCUMENTS

| | | | |
|---|---|---|---|
| 2,970,645 | 2/1961 | Glass | 166/281 |
| 3,289,762 | 12/1966 | Schell et al. | 166/281 |
| 3,712,379 | 1/1973 | Hill | 166/308 X |
| 4,424,859 | 1/1984 | Sims et al. | 166/97.5 X |
| 4,867,241 | 9/1989 | Strubhar | 166/308 |
| 4,945,991 | 8/1990 | Jones | 166/278 |

OTHER PUBLICATIONS

Hassebroek et al., "Hydraulic Fracturing", Modern Well Completion Series, Part 13, *Petroleum Engineer*, Jul. 1961, 6 pages.

*Primary Examiner*—Stephen J. Novosad
*Attorney, Agent, or Firm*—Alexander J. McKillop; Charles J. Speciale; George W. Hager, Jr.

[57] ABSTRACT

A method for producing multiple fractures by a single operation from a single wellbore which penetrates a fracture interval which, in turn, includes a plurality of zones which break-down under different fracturing pressures. Fracturing fluid is delivered from a workstring directly to different levels within a section of the wellbore which lies adjacent the fracture interval through a plurality of alternate paths which, in turn, lie substantially adjacent to the zones to be fractured.

6 Claims, 4 Drawing Sheets

MULTIPLE FRACTURES FROM A SINGLE WORKSTRING

DESCRIPTION

1. Technical Field

The present invention relates to the fracturing of subterranean formations and in one aspect relates to a method for producing multiple fractures from a single workstring in a wellbore by providing alternate flow passages within the wellbore for delivering the fracturing fluid directly to different levels or zones of the formation(s) to be fractured.

2. Background Art

"Hydraulically fracturing" is a well known technique commonly used to increase the permeability of subterranean formations which produce hydrocarbon fluids or the like. In a typical hydraulic fracturing operation, a work string is lowered to a point adjacent the formation(s) to be fractured ("fracture interval"). Fracturing fluid is then pumped out of the lower end of the work string and into the formation at a pressure sufficient to cause the bedding planes of the formation(s) to separate, i.e. "fracture". This separation of the bedding planes creates a network of permeable channels or fractures through which formation fluids can flow into the wellbore after the fracturing operation is completed. Since these fractures have a tendency to close once the fracture pressure is relaxed, props, (e.g. sand, gravel, or other particulate materials) are routinely mixed into the fracturing fluid to form a slurry which, in turn, carries the props into the fractures where they remain to "prop" the fractures open once the pressure is reduced.

Where the fracture interval is substantially homogeneous (i.e. a zone having substantially the same break-down pressure throughout its thickness), standard fracturing techniques such as that described above will normally produce a good distribution of fractures along the length or thickness of the fracture interval. Unfortunately, however, many times the fracture interval lies in reservoirs which are not homogeneous but, instead, the interval consists of several production zones which have substantially different break-down pressures, e.g. layered reservoirs, reservoirs penetrated by inclined and/or hortizontal wellbores, thick reservoirs, reservoirs comprised of several proximate production zones separated by thin impermeable layers, etc..

Problems arise when fracturing these non-homogeneous intervals with conventional fracturing techniques. For example, it is difficult, if possible at all, to fracture a second zone in the fracture interval once a first zone within the interval (i.e. zone with lowest break-down" pressure) has started to fracture. The fractuing fluid slurry will continue to flow into this initial fracture and enlarge it as the pressure increases in the isolated wellbore interval. Further, liquid from the fracture slurry is likely to be "lost" into the initial fracture causing the props, e.g. sand, to settle out of the slurry thereby forming a bridge or blockage within the wellbore adjacent the initially fractured zone. This bridge prevents further flow of slurry to other zones within the fracture interval even if some of these zones may have previously experienced some breakdown. This results in a poor distribution of fractures throughout the fracture interval since normally only the zone having the lowest break-down pressure will be adequately fractured.

SUMMARY OF THE INVENTION

The present invention provides a method for producing multiple fractures by a single operation from a single wellbore which penetrates a fracture interval which, in turn, includes a plurality of zones which break-down under different fracturing pressures. A section of the wellbore which lies adjacent the fracture interval is isolated by packers or by the column of liquid in the well annulus and fracturing fluid is delivered through a plurality of alternate paths directly to the different levels within the isolated section which lie substantially adjacent to the zones to be fractured.

More specifically, if the method is to be carried out in a cased wellbore, the casing is perforated at different levels to provide a plurality of perforations substantially adjacent the different zones in the fracture interval. The section of the cased wellbore lying substantially adjacent the fracture interval is isolated by packers of a column of liquid in the well annulus and fluid communication between the surface and the isolated section is provided through a fracturing apparatus. The fracturing apparatus comprises a workstring having a means for providing alternate flowpaths into the isolated section for delivering fracturing fluid from the workstring directly to the different levels within the isolated section of the wellbore. A fracturing fluid slurry is flowed down the workstring and out the alternate flowpaths to thereby fracture the different zones of the fracture interval.

The fracturing apparatus used to produce the multiple fractures in the present invention is similar to the apparatus used in treating multiple strata as disclosed and claimed in co-pending U.S. patent application No. 07/745,658, filed concurrently herewith and commonly assigned with the present invention. One embodiment of such a fracturing apparatus is comprised of a workstring having a conduit which, in turn, has openings near its lower end which are spaced to coincide substantially to the different zones to be fractured. Another embodiment is comprised of a plurality of conduits of different lengths which are adapted to terminate at different levels within the isolated section of the wellbore. These conduits may be encased within a carrier tube having a lower perforated section; may be carried on a central support tube; or may be fluidly connected to the bottom of a main fluid conduit.

In still another embodiment, the fracturing apparatus may include a workstring which is comprised of a conduit having a perforated section near its lower end which, in turn, is adapted to lie substantially adjacent the fracture interval when the apparatus is in an operable position within the wellbore. A plurality of shunt tubes of different lengths are mounted within the perforated section with their upper ends lying substantially adjacent the upper end of the perforated section and their lower ends terminating at different levels with the perforated section.

BRIEF DESCRIPTION OF THE DRAWINGS

The actual construction, operation, and apparent advantages of the present invention will be better understood by referring to the drawings in which like numerals identify like parts and in which.

BEST KNOWN MODE FOR CARRYING OUT THE INVENTION

Figure 1:
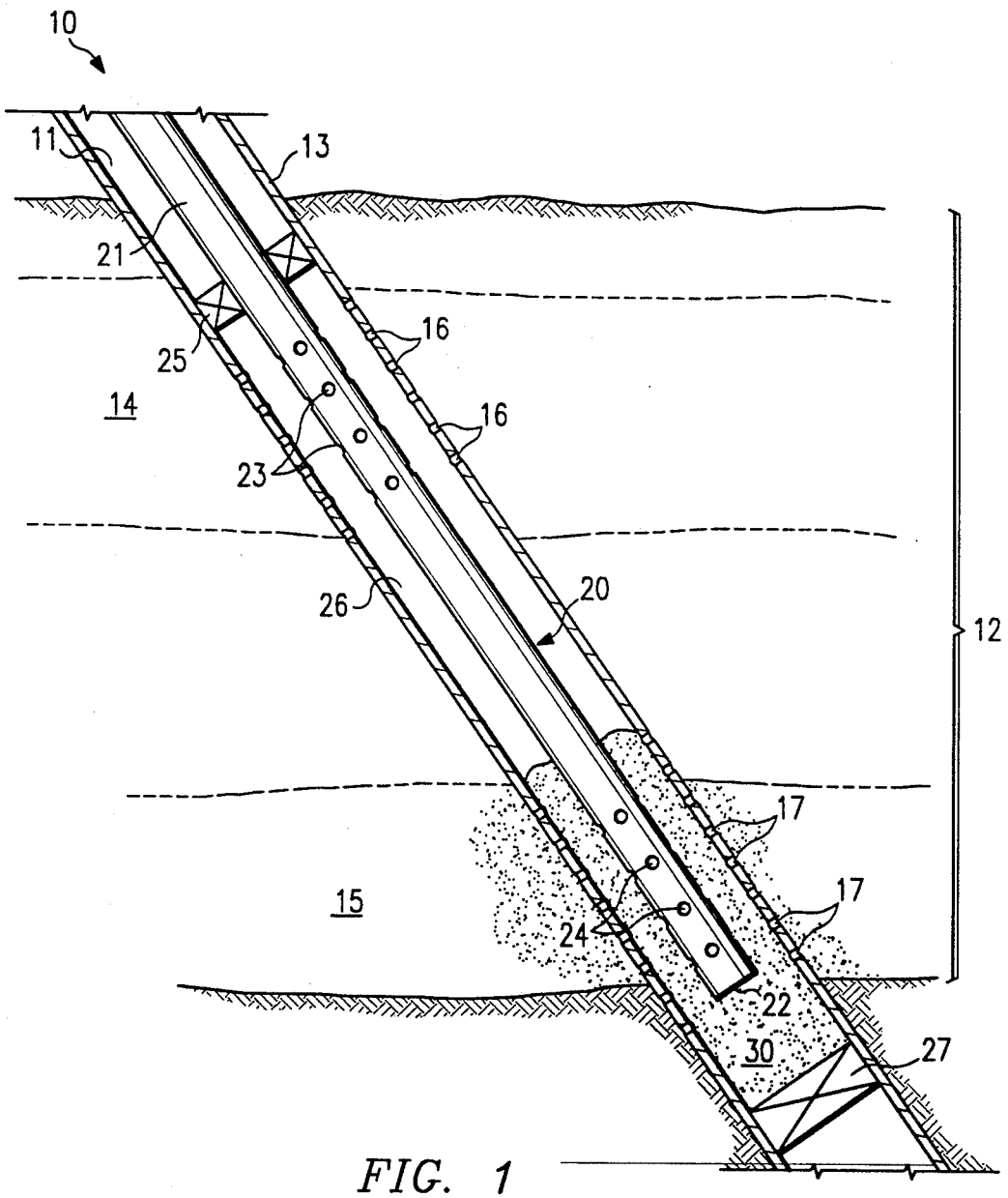
FIG. 1 is an elevational view, partly in section, of an apparatus used in carrying out the present invention as shown in an operable position within a wellbore adjacent a fracture interval.

Referring more particularly to the drawings, FIG. 1 illustrates the lower end of a producing and/or injection well 10. Well 10 has a wellbore 11 which extends from the surface (not shown) through fracture zone 12. Wellbore 11 is typically cased with a casing 13 which is cemented (not shown) in place. While the method of the present invention is illustrated as being carried out in an inclined cased wellbore, it should be recognized that the present invention can equally be used in open-hole and/or underreammed completions as well as in vertical and horizontal wellbores, as the situation dictates.

As illustrated, fracture interval 12 is comprised of a plurality (only two shown) of zones 14, 15 which have different break-down pressures. Casing 13 is perforated at different levels to provide at least two sets of perforations 16, 17 which lie substantially adjacent zones 14, 15, respectively. Since the present invention is appliable in horizontal and inclined wellbores, the terms "upper and lower", "top and bottom", as used herein are relative terms and are intended to apply to the respective positions within a particular wellbore while the term "levels" is meant to refer to respective positions lying along the wellbore between the terminals of the fracture interval.

A fracturing apparatus 20 is positioned in wellbore 11 substantially adjacent fracture interval 12. Fracturing apparatus 20 is comprised of a workstring 21 which is closed at its lower end 22 and which extends to the surface (not shown). Workstring 21 has a plurality of openings (e.g. upper and lower sets of openings 23, 24, respectively) which are spaced above the lower end 22 to coincide roughly with casing perforations 16, 17, respectively. While appropriate packers 25 and 27 are shown as isolating the section 26 of wellbore 11 which lies adjacent fracture interval 12, as will be recognized by those skilled in the art, the column of liquid (not shown) which is normally present in the shut-off annulus of the well is often used to effectively isolate the fracture interval without the need of upper packer 25. As used herein, "isolated section" is intended to cover both an interval that is isolated by either packers or the like and that isolated by liquid in the annulus.

In operation, a fracturing slurry having particulate material or props, e.g. sand, is pumped down workstring 21 and out through upper and lower openings 23, 24 into the isolated section 26 of wellbore 11. As section 26 fills with slurry and the pressure increases, the slurry is forced through casing perforations 16, 17 and attempts to enter zones 14, 15 of the fracture interval 12. However, since, as illustrated, zone 15 has a lower break-down pressure, the slurry takes the path of least resistance and enters and fracture zone 15 first.

In a conventional fracturing operation where the slurry only exits through the lower end of a workstring, once zone 15 breaks down, the slurry will continue to flow into zone 15 to enlarge the initial fracture while little or no slurry is forced through the upper casing perforations 16 into zone 14. Eventually, fluid from the slurry is lost into the initially fractured zone 15 causing the sand in the slurry to settle to form a bridge 30 (FIG. 1) in the wellbore. Bridge 30 blocks any further flow of slurry to zone 14 resulting in a poor distribution of fractures throughout fracture interval 12. This may result in the workstring having to be repositioned, packers reset, etc. in order to provide the desired multiple fractures within fracture interval 12.

In the present invention, even after zone 15 has been fractured and/or sanded off, slurry can continue to flow through upper openings 23, i.e. alternate flowpaths, in the workstring 21. As the pressure builds above the break-down pressure of zone 14, slurry will be forced through casing perforations 16 to fracture zone 14. While only two zones in the fracture interval and two sets of openings in the workstring and casing have been illustrated, it should be understood that the workstring of the present invention may have openings at more than two levels to service more than two zones in the desired fracture interval. The important feature is to provide alternate flow paths for the slurry to the different levels or zones of the fracture interval so that multiple fractures can be produced from a single workstring. The slurry will continue to be delivered to the respective levels in the interval to fracture the respective zones until all of the zones have been fractured regardless of which zone fractures first or whether or not sand bridges form in the wellbore during the fracture operation.

While in most operations the fracturing fluid will flow simultaneously through all of the alternate flowpaths to all of the different levels within the fracture interval, there may be times that it will be desired to fracture the zones of a particular fracture interval in a preferred sequence. Accordingly, the respective openings in the workstring can be sized so that the slurry will seek the path of least resistance and will flow primarily through the larger openings in the workstring which are positioned adjacent the first zone to be fractured, then through a second set of smaller openings positioned adjacent a second zone, and so forth until all of the zones have been fractured. Also, valve means (not shown), e.g. discs which rupture at different pressures, may be used to close openings in the workstring at particular levels so that no flow will occur through these openings until a desired pressure is reached.

Figure 2:
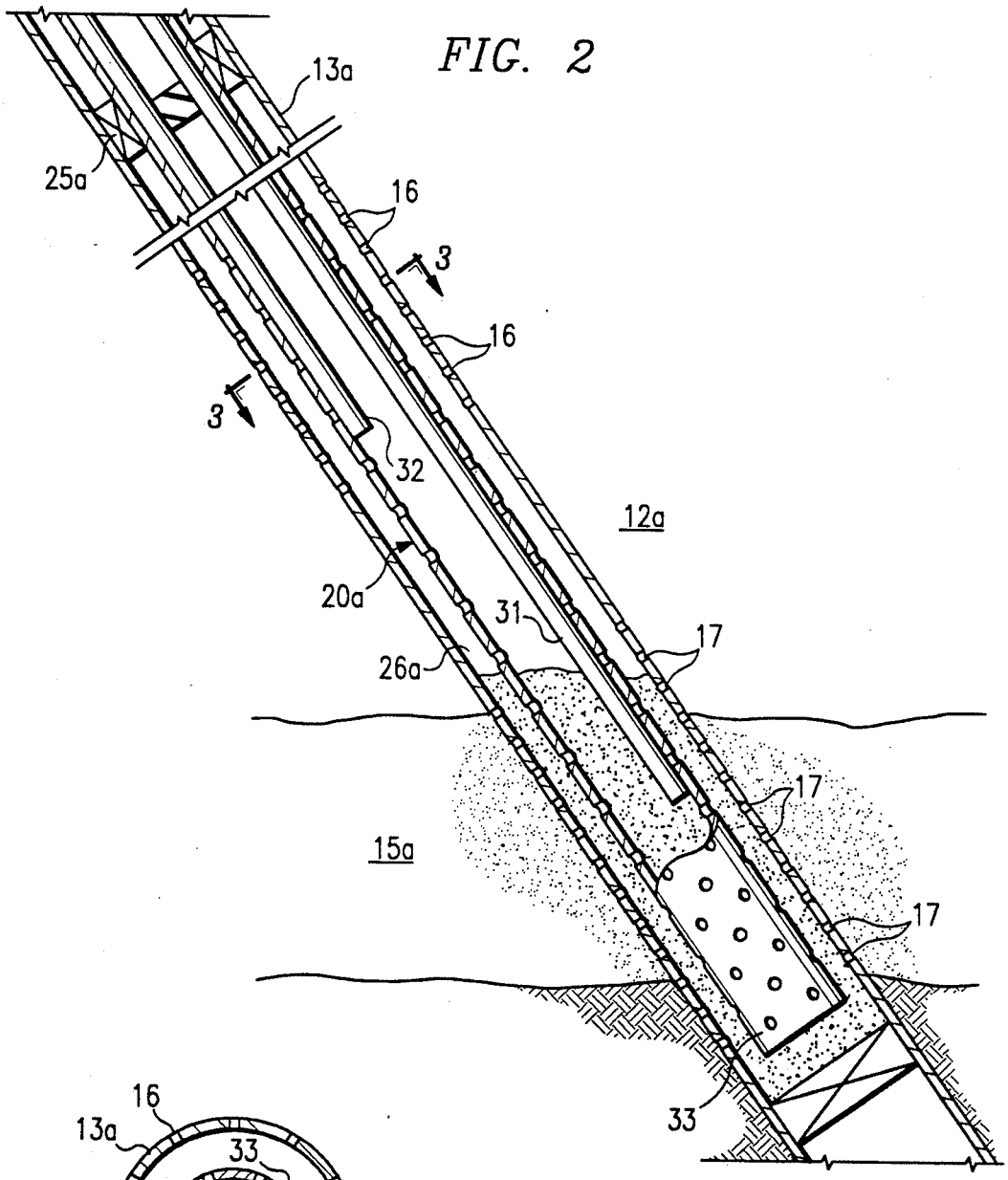
FIG. 2 is an elevational view, partly in section, of an embodiment of the apparatus of FIG. 1.
Figure 3:
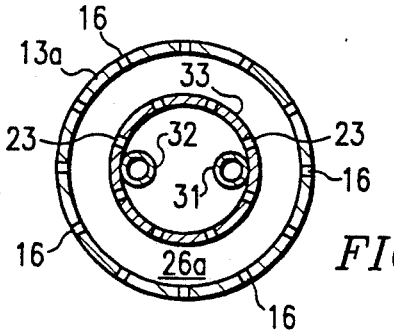
FIG. 3 is a sectional view taken along line 3—3 in FIG. 2.

FIGS. 2 and 3 illustrate another embodiment of a fracturing apparatus **20*a* which can be used to carry out the present invention. Apparatus 20*b* is comprised of a bundle or plurality of conduits 31, 32 (only two shown) which are mounted and encased within perforated carrier tube 33 which, in turn, provides structural integrity and support for the conduits. Conduits 31, 32 may be of different lengths (as shown) so that they terminate at different levels within tube 33 and open only at their lower ends or they may be of equal or varying lengths with openings (not shown) at different levels to coincide substantially with the different perforations in casing 13*a***.

As seen in FIG. 2, slurry is delivered out the lower ends of the individual conduits 31, 32 to fill the lower end of carrier tube 33. The slurry will flow out of the perforations in tube 33 to fill isolated section **26*a* of the wellbore. As described above, the slurry initially breaks-down zone 15***a* since it has the lowest breakdown pressure. When this occurs and even if a sand bridge forms and blocks the flow through the lower end of carrier tube 33, slurry will continue to be delivered through conduit 32 and the upper perforations in tube 33 to fracture the second zone (not shown) in the fracture interval 12*a*.

Figure 4:
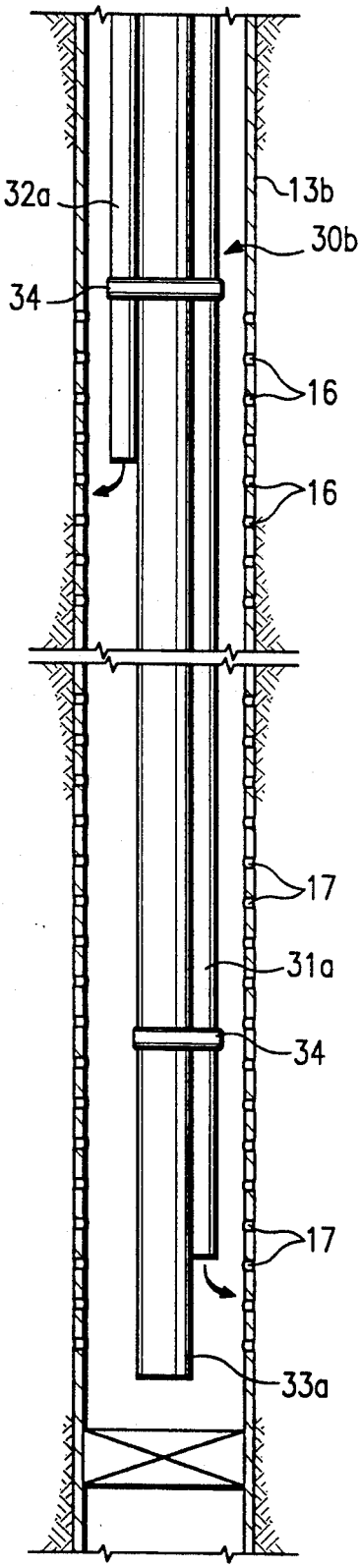
FIG. 4 is an elevational view, partly in section, of a further embodiment of the apparatus of FIG. 1.

FIG. 4 illustrated a fracturing apparatus 30*b* which is similar to fracturing apparatus 30*a* having a plurality of conduits 31*a*, 32*a* which are mounted on and carried by a central tubular member 33*a*. Bands 34 or the like secure the conduits onto the outer surface of central member 33. The conduits 31*a*, 32*a* terminate at different levels and are used to carry out the multiple fracturing operation in the same manner as described above in relation to the facturing apparatus 30*a*.

Figure 5:
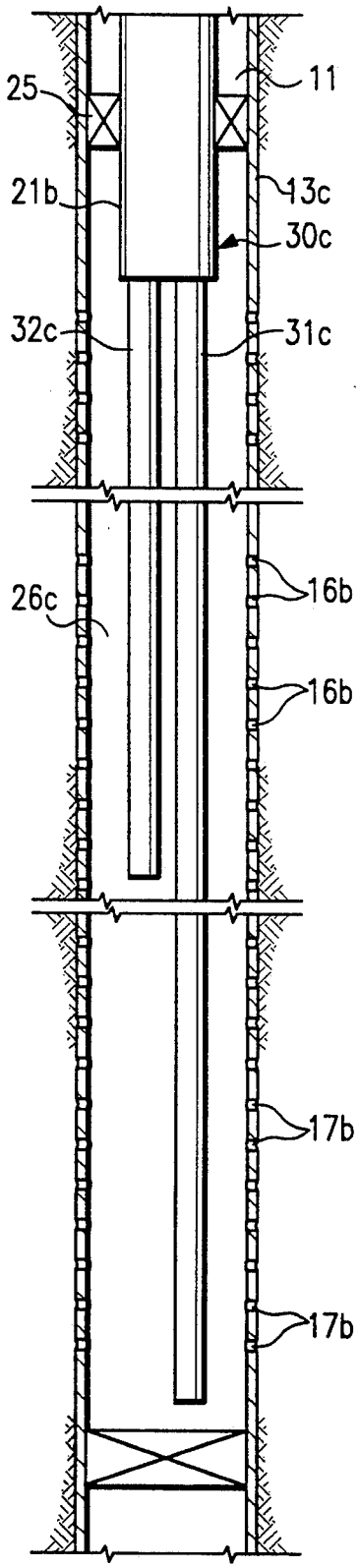
FIG. 5 is an elevational view, partly in section, of another embodiment of the apparatus of FIG. 1.

FIG. 5 illustrates a further embodiment of a fracturing apparatus 30*c* which is comprised of a workstring 21*b* which, in turn, is adapted to extend downward into wellbore 11 to a point which is substantially adjacent the top of the fracture interval 12*c*. A plurality of conduits 31*c*, 32*c* (only two shown) having different lengths are connected to the bottom of workstring 21*b* and are in fluid communication therewith. When apparatus 30*c* is in an operable position within the wellbore, conduits 31*c*, 32*c* will terminate at different levels within the wellbore adjacent different zones of the fracture interval. Fracturing slurry flows down workstring 21*b* and is delivered directly to different levels within the isolated section 26*c* through the conduits (i.e. alternate paths) to carry out the fracturing operation as described above.

Figure 6:
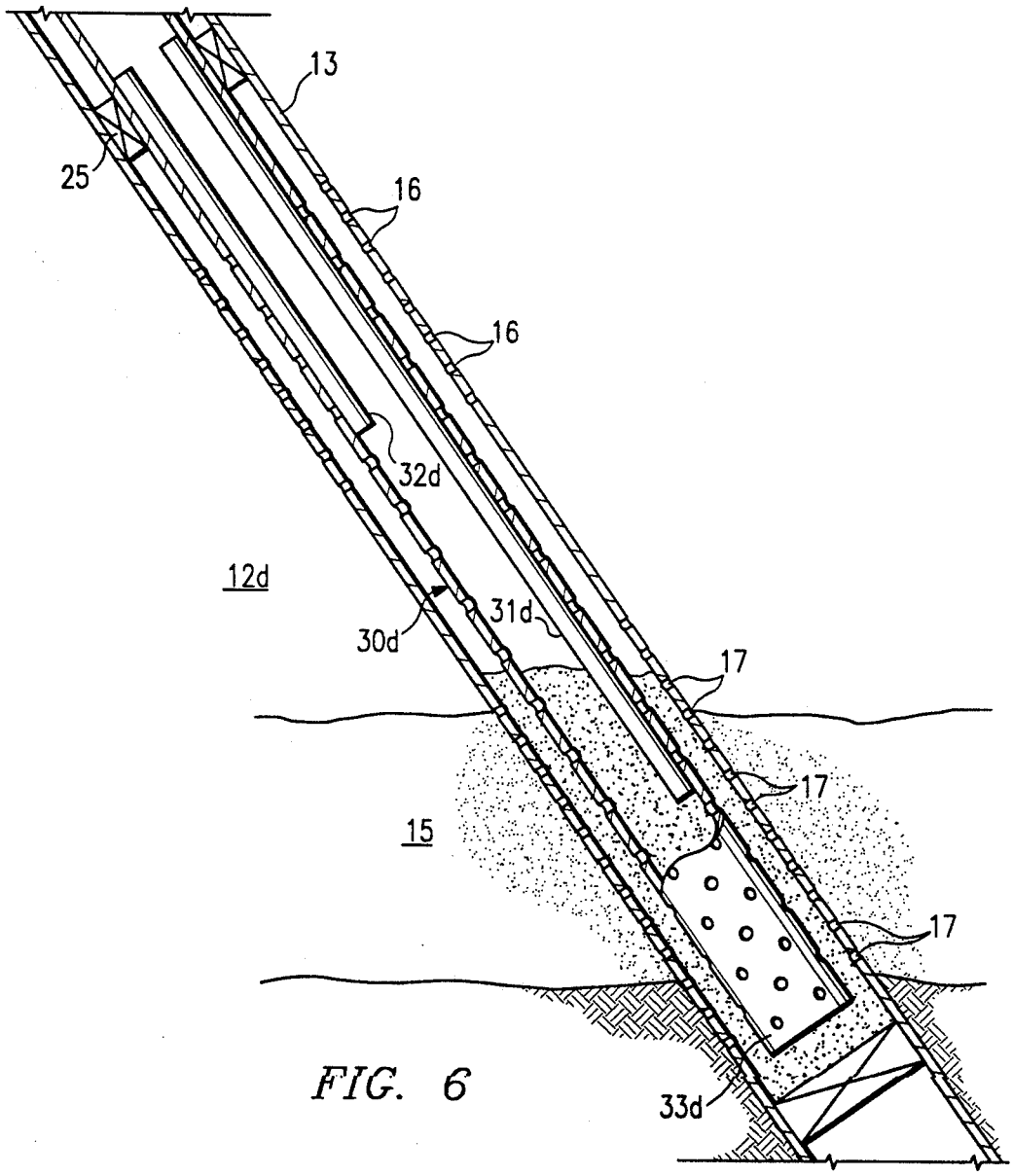
FIG. 6 is an elevational view, partly in section, of still another embodiment an apparatus used to carry out the present invention.

Still another embodiment of a fracturing apparatus which can be used to carry out the present method is shown in FIG. 6. Fracturing apparatus 30*d* is comprised of a carrier tube 33*d* having a perforated lower section which is adapted to lie substantially adjacent to fracture interval 12*d* when apparatus 30*d* is in an operable position within wellbore 11*d*. A plurality of shunt tubes 31*d*, 32*d* (only two shown) of different lengths are mounted within the perforated section of the workstring with their upper ends lying substantially adjacent the upper end of the perforated section and their respective lower ends terminating at different levels within the perforated section. The shunts tubes are open at both their upper and lower ends to allow fluid flow therethrough.

In operation, fracturing slurry flows down the workstring and out the perforated section at the lower end thereof. At the same time, slurry is flowing through the shunts tubes (i.e. alternate paths) and the adjacent openings in the perforated section to be delivered directly to the respective different levels. If one zone fractures first and/or a sand bridge is formed before the fracture operation is complete, slurry can still flow through the other shunt tubes to fracture the other zones within the fracture interval.

What is claimed is:

1. A method for producing multiple fractures in a single operation from a single wellbore which, in turn, penetrates a fracture interval which includes a plurality of zones which break down under different pressures, said method comprising:

isolating a section of the wellbore which lies substantially adjacent said fracture interval;

delivering fracturing fluid through alternate flowpaths directly adjacent different levels within said isolated section which lie substantially adjacent said respective zones within said isolated section;

continuing delivery of fracturing fluid directly to said different levels within said isolated section to thereby fracture the different zones within said fracture interval.

2. The method of claim 1 wherein said fracturing fluid is delivered simultaneously through said alternate flowpaths.

3. The method of claim 1 wherein said alternate flowpaths are formed of individual conduits whose lower ends terminate substantially adjacent the respective different levels.

4. The method of claim 1 wherein said fracturing fluid is delivered to said alternate flowpaths by a workstring which is positioned within said wellbore.

5. The method of claim 4 wherein said alternate flowpaths are formed by openings which are spaced along the lower end of said workstring and positioned to lie substantially adjacent the respective different levels.

6. The method of claim 4 wherein said alternate flowpaths are formed by a plurality of shunt tubes positioned within the lower end of said workstring which have their respective lower ends terminating substantially adjacent said different levels.

* * * * *